United States Patent [19]

Love

[11] Patent Number: 4,986,043

[45] Date of Patent: Jan. 22, 1991

[54] DEVICE FOR ERECTING AND PLUMBING A WALL FRAME UNIT

[76] Inventor: Gordon L. Love, 11870 Long Lake Dr., Sparta, Mich. 49345

[21] Appl. No.: 485,485

[22] Filed: Feb. 28, 1990

[51] Int. Cl.[5] ..... E04G 21/04

[52] U.S. Cl. ..... 52/127.2; 52/749; 269/131; 269/41; 269/53; 33/613

[58] Field of Search ..... 52/127.1, 127.5, 127.6, 52/127.7, 127.8, 127.9, 749, 127.2; 269/41, 43, 53, 131, 132; 33/613, 645

[56] References Cited

U.S. PATENT DOCUMENTS 2,962,129 11/1960 Walton .
3,574,981 4/1971 Henschen .
4,098,037 7/1978 Day .
4,420,921 12/1983 Hardin ..... 52/749
4,704,829 11/1987 Baumker, Jr. ..... 33/613 X
4,753,426 6/1988 Varkala ..... 269/53

*Primary Examiner*—David A. Scherbel
*Assistant Examiner*—Creighton Smith
*Attorney, Agent, or Firm*—Terry M. Gerstein

[57] ABSTRACT

A device for moving a wall frame unit into an erect and plumb position includes a pulling unit mounted on one wall frame unit and a pulled unit mounted on the wall frame unit to be erected. A cable unit connects the pulled unit to the puller unit via a lock handle on the puller unit. Movement of the puller unit handle into a prone position draws the cable unit towards the puller unit. A differential pulley block is included so that one worker can, without assistance, move the second wall frame unit.

10 Claims, 4 Drawing Sheets

DEVICE FOR ERECTING AND PLUMBING A WALL FRAME UNIT

TECHNICAL FIELD OF THE INVENTION

The present invention relates to the general art of static building structures, and to the particular field of accessories used in erecting such static building structures.

BACKGROUND OF THE INVENTION

Most static building structures, such as houses, or the like, include a frame unit on which interior and exterior panels are mounted, and on which insulation, electrical elements and plumbing elements are mounted. Such frame units generally include wall frames mounted on a foundation unit and roof frames mounted on top of the wall frames.

The wall frames generally includes a plurality of studs mounted at spaced apart locations on a bottom or sole plate at a lower end and have a top plate attached thereto at a top end. The wall frames also include corner posts, window and door frame units, and like elements. The wall frame units can be, and generally are, completed prior to erected them onto the bottom plate. A completed wall frame unit is placed adjacent to the foundation of the building, elevated into a vertical orientation, and attached to an adjacent frame element, such as an in-place wall frame unit.

The erection of a wall frame into place may require as many as three people, and is sometimes inaccurate. This step in the overall erection process is therefore susceptible to inefficiency and can be wasteful of manpower and time.

The art has included various brace units to assist in the erection and plumbing of frame walls. However, these units are generally cumbersome to use and not well suited for permitting a wall frame unit to be erected and plumbed by a single, unassisted worker.

Therefore, there is a need for a device for erecting and plumbing a wall frame unit which will permit such wall frame unit to be erected and plumbed by a single, unassisted worker.

OBJECTS OF THE INVENTION

It is a main object of the present invention is to provide a device for erecting and plumbing a wall frame unit.

It is another object of the present invention to provide a device for erecting and plumbing a wall frame unit which will permit such wall frame unit to be erected and plumbed by a single, unassisted worker.

SUMMARY OF THE INVENTION

These, and other, objects are achieved by an assembly which includes a pulling unit mounted on one frame wall and a pulled unit mounted on a second pulled wall and which are connected together by a cable unit.

The cable unit further includes means for pulling the pulled unit towards the pulling unit thereby drawing the one frame wall toward the second frame wall. The units are mounted on top of the frame walls and the cable unit includes a differential pulley block.

Using this assembly, a single, unassisted worker can move one frame wall unit from a horizontal orientation to a vertical, plumb orientation by manipulating the assembly Such as single worker operation will be efficient and will make maximum use of available manpower.

BRIEF DESCRIPTION OF THE DRAWING FIGURES

DETAILED DESCRIPTION OF THE PREFERRED EMBODIMENT OF THE INVENTION

Figure 1:
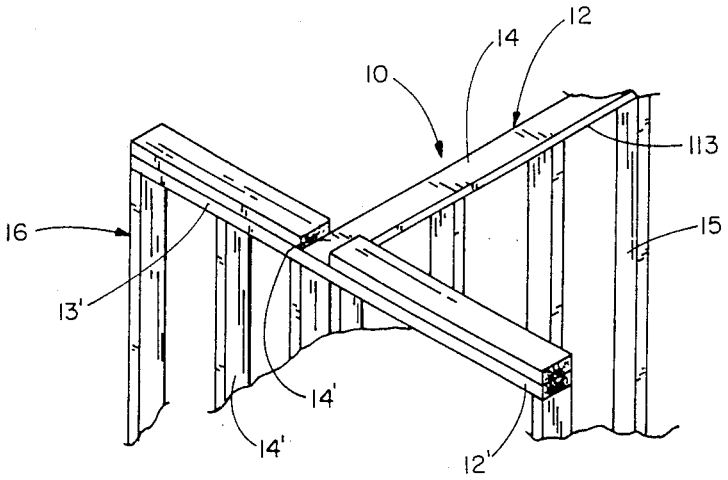
FIG. 1 is a top perspective view of two adjacent, erected frame wall units.

Shown in FIG. 1 is a first wall frame unit 10 that has been previously erected and plumbed to have its bottom mounted on the building foundation and to have a top plate 12 located in an elevated position with respect to the foundation. The top plate includes a top surface 13 and a side surface 14. A plurality of studs, such as stud 15 are each mounted at a lower end thereof on a sole plate and extend to an upper end to be affixed to the top plate, with the top plate 12 forming the top of the wall frame unit. A second wall frame unit 16 includes a bottom edge, a plurality of spaced-apart studs 15' and a top plate 12' having a side surface 13' and a top surface 14', and is completed while it is in a separate location, moved into position adjacent to the first wall frame unit 10, and then erected and plumbed by placing the bottom of that wall frame unit 16 on the foundation, and hoisting the wall frame unit into an upright orientation. The two wall frame units are then attached together.

As above discussed, moving the second wall frame unit 16 into the vertical plumb orientation and attaching it to the first wall frame unit 10 often requires two or three workers, and is thus a source of inefficiency and wasted manpower.

Figure 2:
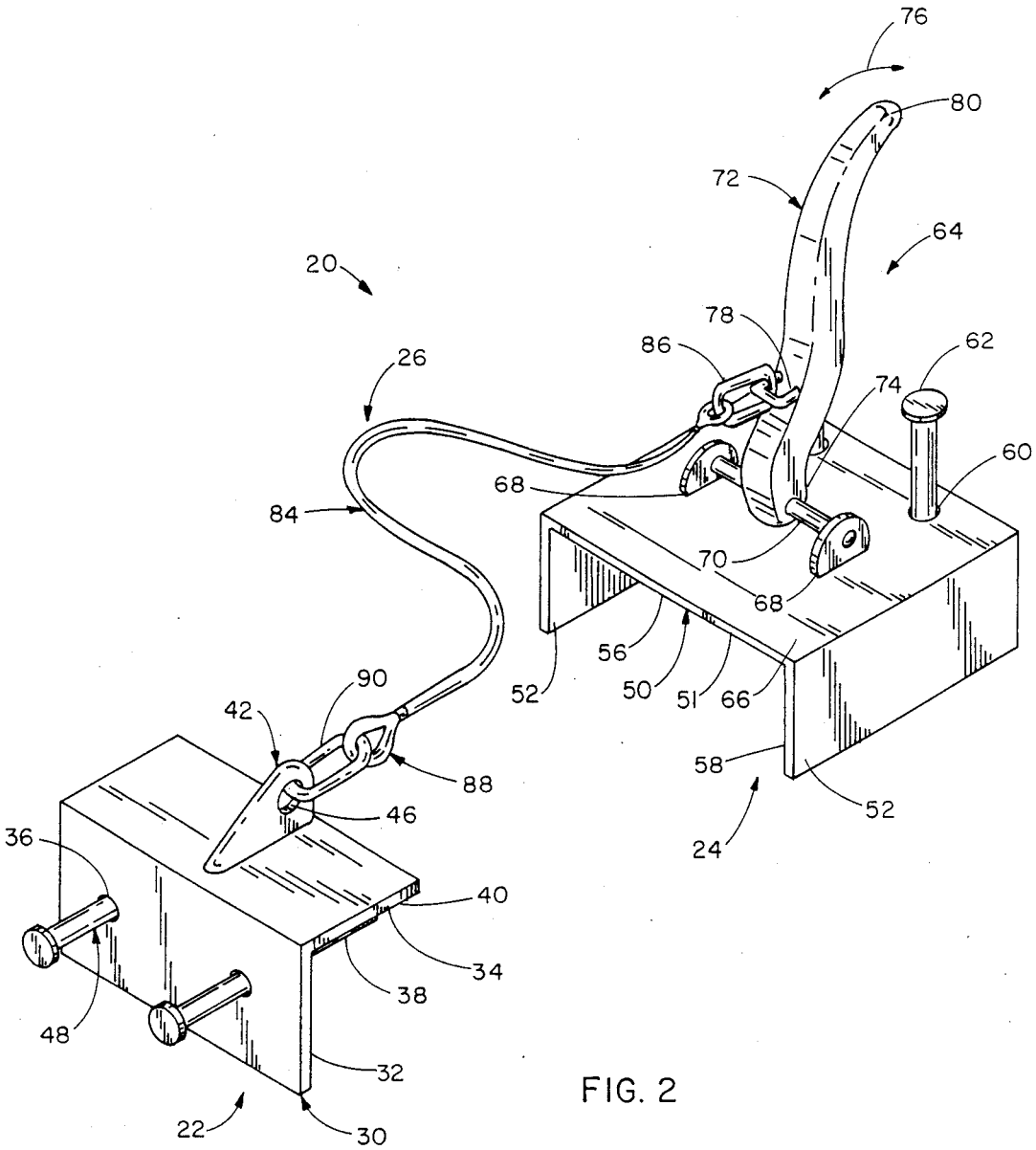
FIG. 2 is a perspective view of a device for erecting and plumbing a wall frame unit.

The present invention is embodied in an assembly 20, best shown in FIG. 2, which permits a single, unassisted worker to move the wall frame unit 16 into the erect, plumb position adjacent to the first wall frame unit 10.

The assembly 20 includes a pulled unit 22 which is mounted on top of the second wall frame unit 16, and a puller unit 24 that is mounted on top of the first wall frame unit 10. The puller unit is connected to the pulled unit by a cable unit 26 so that the pulled unit 22 can be drawn towards the puller unit thereby drawing the wall frame unit 16 is moved into an upright position adjacent to the wall frame unit 10. The cable unit 26 is shown in FIG. 2 in the final plumbing condition.

The pulled unit 22 includes a monolithic, one-piece L-shaped angle bracket 30 having a first leg 32 and a second leg 34. The first leg includes two fastener-receiving holes, such as hole 36, defined therethrough, and the second leg includes adhesive 38 on an undersurface 40 thereof. The first leg is adapted to engage the wall frame unit top side surface 13', and the second leg is adapted to engage the wall frame unit top surface 14'.

An ear element 42 is located on top surface 44 of the second leg 34 and includes an opening 46 defined therethrough, and fasteners, such as nails 48, are received through the fastener-receiving holes to affix the pulled unit 22 to the second wall frame unit 16 for movement therewith.

The puller unit 24 includes a monolithic, one-piece, C-shaped body section 50 that includes a central section 51 and a side section 52 on either side thereof. The puller unit body is sized and adapted to have undersurfaces 56 and 58 thereof respectively engage the top surface 14 and the side surfaces 13 of the first wall frame unit to firmly straddle that wall frame unit. The puller unit 24 further includes fastener-receiving holes, such as hole 60 through which fasteners, such as nail 62, are received to affix the unit 24 to the wall frame unit.

A handle unit 64 is mounted on top surface 66 of the central body section 50 and includes two trunnions 68 mounted on that top surface 66 and a pivot pin 70 mounted at each end thereof to each of the trunnions and extending therebetween above the top surface 66. The handle unit further includes a lock handle element 72 mounted at a proximal end 74 thereof o the pivot pin to pivot about such pivot pin in the directions indicated by the double-headed arrow 76 from a position extending along the top element 12 to a position as shown in FIG. 2 extending essentially perpendicular to that top element 12. A U-shaped fastener 78 is mounted on the lock handle element 72 between the proximal end 74 thereof and a distal end 80 thereof.

The cable unit 26 includes a flexible cable 84 which has a coupling ring 86 on one end thereof and a quick-release ring 88 on the other end thereof. The ring 86 is affixed to the bracket 78 and the quick-release ring 88 is removably attached to a link 90 affixed to the ear 42.

Figure 4:
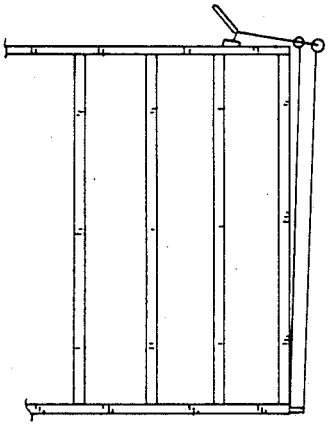
FIG. 4 is a side elevational view of the device of the present invention in combination with two adjacent wall frame units.
Figure 3:
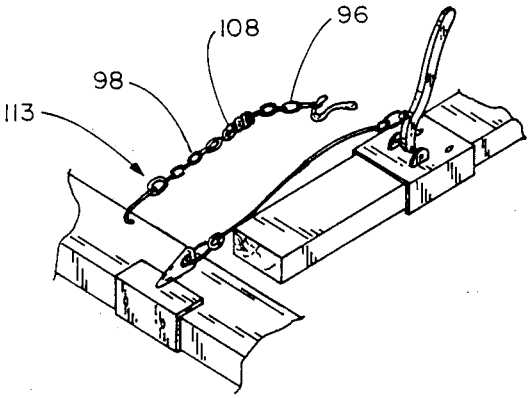
FIG. 3 is a top perspective view of the device of the present invention in operation to draw a first wall frame unit towards a second wall frame unit to erect and plumb that second wall frame unit.

Referring to FIGS. 3 and 4, it can be seen that the pulled unit 22 is affixed to the top of the second wall frame unit and the puller unit 24 is affixed to the first wall frame unit. The second wall frame unit is moved into a vertical orientation and the cable unit 26 is attached to the pulled unit via the quick-release ring 88, and the handle 72 is moved from the upright position shown to a horizontal position to pull the pulled unit, and the second wall frame unit, toward the puller unit, and the first wall frame unit.

Figure 5:
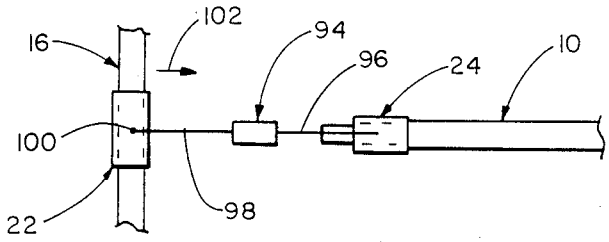
FIG. 5 is a top plan view of the device of the present invention in which a pulley block is included to assist in the movement of one frame unit into a vertical plumb orientation.
Figure 6:
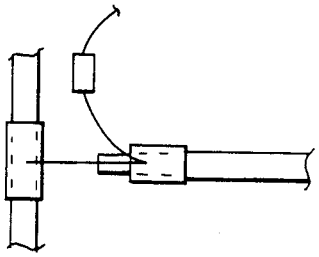
FIG. 6 is a top plan view of the device in which the pulley unit is inactivated.

In order to permit the entire operation to be carried out by a single, unassisted worker, the assembly further includes a pulley block 94 as indicated in FIGS. 5 and 6. The pulley block includes a first cable portion 96 fixed to the bracket 78 at one end thereof and to the pulley block at the other end thereof. A second cable portion 98 has a quick-release ring 100 on one end and is attached to the pulley block at the other end. The quick-release ring 100 is attached to the ear 42 to couple the pulley block to the second wall frame unit. Operation of the pulley block moves the second wall frame unit toward the first wall frame unit in the direction indicated by arrow 102.

The second wall frame unit is moved into adjacency with the first wall frame unit as indicated in FIG. 5, and the pulley block is disconnected from the second wall frame unit by releasing the quick-release ring 100. The cable 84 is then connected to the ear via the quick-release ring 88, and the handle 72 operated to complete the erecting and plumbing operation.

Figure 7:
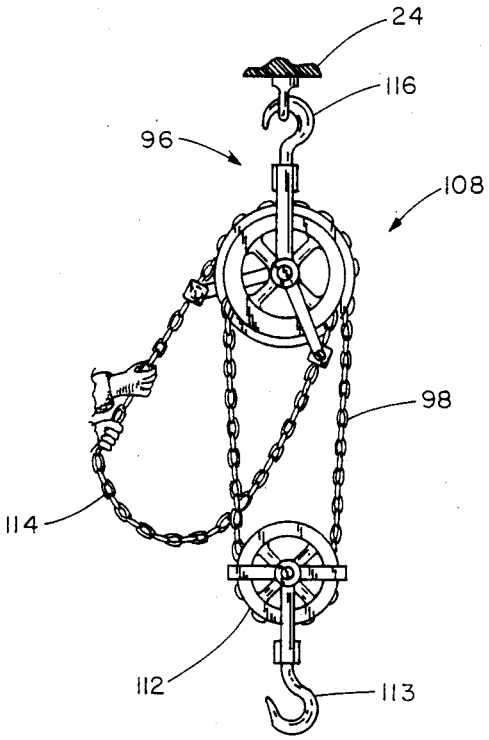
FIG. 7 is a side elevational view of a Weston's differential pulley block used to draw one wall frame unit into an upright orientation.
Figure 8:
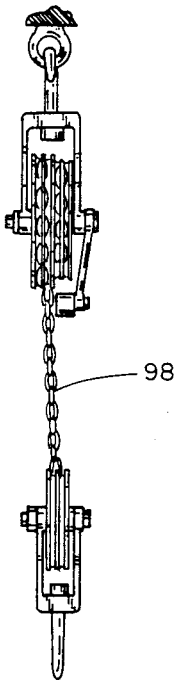
FIG. 8 is an end elevational view of the Weston's differential pulley block.

A pulley block is shown in FIGS. 7 and 8 as a Weston's differential pulley block 108 having two grooved pitched sheave 110 in combination with a return block 112. The cable portion 98 is an endless cable as is indicated in FIGS. 7 and 8. The quick-release ring 100 is shown in FIGS. 7 and 8 as a hook and the block 108 includes an operating chain 114. The block is shown connected to the bracket 78 via a hook 116, but preferably is a fixed connection. Cable portion 96 is omitted from FIGS. 7 and 8 for the sake of clarity of showing for the pulley block itself, but is indicated in such figures.

Figure 9:
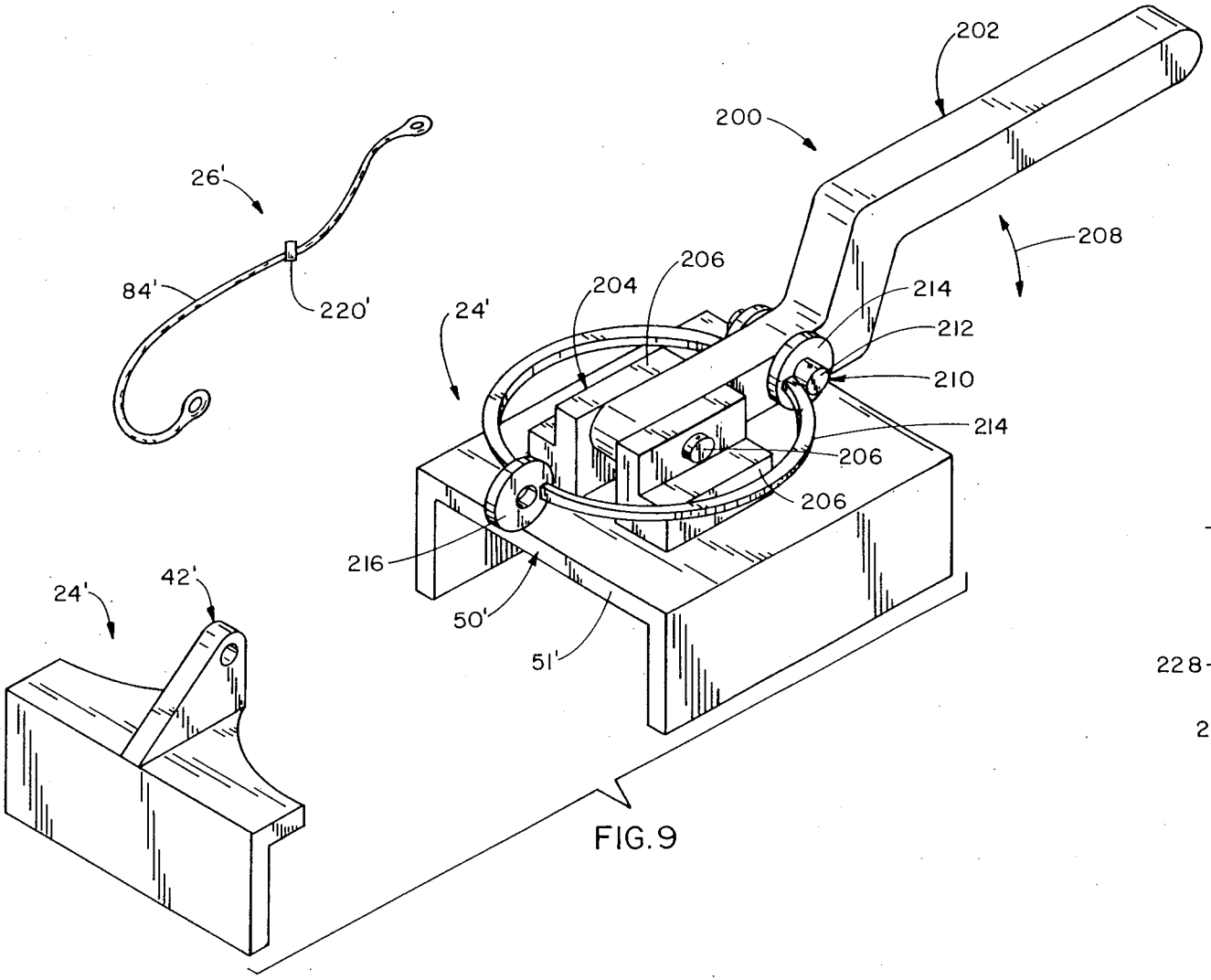
FIG. 9 is an alternative embodiment of the device of the present invention.

An alternative assembly 20' is shown in FIG. 9 as including a pulled unit 22' and a puller unit 24'. A connecting unit 26' connects the puller to the pulled unit.

The pulled unit 22' is similar to the pulled unit 22, and can include any suitable means for attaching such pulled unit to the wall, such as the fasteners and fastener-receiving holes discussed above in regard to unit 22.

The pulling unit 24' includes a body section 50' and suitable means for attaching such unit to a wall, such as the fasteners and fastener-receiving holes discussed above with regard to unit 24. The unit 24' has a lever assembly 200 mounted on the central section 51' that is connected to one end of a cord 84' of the connecting unit 26', with the other end of the cord 84' being connected to the pulled unit 24' at ear 42'.

The lever assembly 200 includes a lever arm 202 pivotally connected to the body 50' at a pivot 204 that is mounted on the section 51' and includes two L-shaped support standards 206. A pivot rod 208 is mounted on the standards, and the lever arm 202 is attached thereto for movement in the directions indicated by double-headed arrow 208.

An attachment unit 210 includes a pin 212 attached to the lever arm, and washers, such as washer 214 mounted on the pin 212. A ring 214 is attached to the washers 214 and has an attachment disc 216 mounted thereon. One end of the cord 84' is attached to the attachment disc to be moVed as the lever arm moves in the directions 208. Such movement of the cord and the lever arm will move the pulled unit, and any wall attached thereto, towards the pulling unit, and any wall attached thereto.

Figure 10:
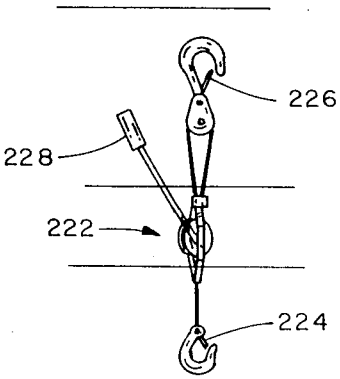
FIG. 10 shows a ratchet device that can be used in conjunction with the device of the present invention.

To further assist the assembly 20' in moving a wall, a further pulling unit 220 is included in the connecting unit 26. This further pulling unit can include a ratchet element 222 as shown in FIG. 10. The ratchet element 222 includes a first end 224 which is attached to one portion of the cord 84' and a second end 226 which is attached to another portion of the cord 94'. Operation of the ratchet element by movement of handle 228 operates a ratcheting mechanism that is familiar to those skilled in the art to pull ends 226 and 228 towards each other, thereby moving the pulled unit towards the pulling unit.

It is understood that while certain forms of the present invention have been illustrated and described herein, it is not to be limited to the specific forms or arrangements of parts described and shown.

I claim:

1. A device for drawing two wall frame units together comprising:

(A) a pulled unit which is mounted on a first wall frame unit and which includes (1) a monolithic, one-piece L-shaped angle bracket having first and second legs and fastener-receiving holes defined through said first leg, (2) said first wall frame unit including a top area, a side surface adjacent to said top area and a top surface adjacent to said top area, (3) said angle bracket having said first leg engaged against a top area side surface, and said second leg engaged against said top area top surface, and having a bracket top surface, (4) an ear mounted on said bracket top surface and having an opening defined therethrough, and (5) fasteners attaching said angle bracket to said first wall frame unit adjacent to said top area;

(B) a puller unit which is mounted on a second wall frame unit and which includes (1) said second wall frame unit including a top area having a side surface and a top surface, (2) a monolithic, one-piece C-shaped bracket mounted on said second wall frame unit adjacent to said second wall frame unit top area and including (a) a central body section having a top surface and an under surface in contact with said second wall frame unit top surface, (b) two side flanges on sides of said central body section, (c) fastener-receiving holes defined in said central body section, and (d) fasteners extending through said puller unit central body section fastener-receiving holes and attaching said C-shaped bracket to said second wall frame unit, (3) two spaced apart trunnions mounted on said central body section top surface, (4) a pivot pin attached at each end thereof to one of said trunnions and extending therebetween above said central body section top surface, and (5) a lock handle having a proximal end pivotally attached to said pivot pin and moving from a position extending along said second wall frame unit top surface to a position extending essentially perpendicular to said second wall frame unit top surface, said lock handle having a distal end located remote from said proximal end, and a U-shaped fastener attached to said lock handle between said proximal end and said distal end; and (C) a cable unit having a flexible cable having a quick-release ring on one end thereof and a mounting ring on another end thereof, said mounting ring being fixed to said lock handle U-shaped fastener to move with said lock handle; and (D) a coupling ring fixed to said pulled unit ear via said ear opening, said cable unit quick-release ring being coupled to said coupling ring to attach the first wall frame unit to the second wall frame unit via said pulled unit, said puller unit and said cable unit.

2. The device defined in claim 1 wherein said cable unit includes two flexible cable portions.

3. The device defined in claim 2 further including adhesive on said pulled unit angle bracket.

4. The device defined in claim 2 wherein said cable unit further includes a pulley block unit.

5. The device defined in claim 4 wherein said pulley block unit includes a differential pulley block.

6. The device defined in claim 5 wherein said differential pulley block includes an endless cable and a guide cable.

7. The device defined in claim 6 wherein said differential pulley block includes a Weston's differential pulley block.

8. The device defined in claim 2 wherein said cable unit further includes a ratchet assembly.

9. The device defined in claim 8 further including a lever arm on said puller unit and a ring on said lever arm.

10. The device defined in claim 9 further including a disc element on said ring.

* * * * *